United States Patent [19]

Chen

[11] Patent Number: 4,611,450

[45] Date of Patent: Sep. 16, 1986

[54] MULTI-REINFORCED CONSTRUCTION PANEL

[76] Inventor: Kai-Nan Chen, No. 111 Chien Chung Street, Taichung, Taiwan, 400

[21] Appl. No.: 533,429

[22] Filed: Sep. 16, 1983

[51] Int. Cl.[4] ..... E04C 1/00; D03D 13/00; B32B 5/14

[52] U.S. Cl. ..... 52/309.4; 52/309.7; 52/309.12; 52/383; 52/650; 428/222; 428/308.4; 428/312.8

[58] Field of Search ..... 52/309.4, 309.7, 309.12, 52/383, 650; 428/222, 308.4, 312.8

[56] References Cited

U.S. PATENT DOCUMENTS 4,104,842 8/1978 Rockstead et al. ..... 52/309.12 X

FOREIGN PATENT DOCUMENTS 2327045 5/1977 France ..... 52/309.12

*Primary Examiner*—Thurman K. Page

*Attorney, Agent, or Firm*—Berman, Aisenberg & Platt

[57] ABSTRACT

A multi-reinforced construction panel comprising a metal wire mesh or plate folded by a press machine to take the shape of acute V formations, square wave formations, natural wave formations, or trapezoidal formations to work structurally as folded plates. Both side of said folded metal mesh or plates are covered with two metal meshes shaped like two flat panels, to be secured to embodiments by welding. The two flat metal meshes can have different fabric to enforce the framework structurally a light-weight raw material, such as expanded polystyrene or foamed PU, is used to insert onto the back and loin sections of the metal wire skeleton structure produced accordingly, so as to build up an accomplished multi-reinforce construction panel.

8 Claims, 8 Drawing Figures

MULTI-REINFORCED CONSTRUCTION PANEL

BACKGROUND OF THE INVENTION

The present invention relates to a multi-reinforced construction panel, more particularly to one fabricated from wire-mesh or metal plate folded to specific configurations, such as acute V formations, square wave formations, natural wave formations, or trapezoidal formations, and to lightweight materials inserted onto the loin section of the folded mesh or plate; also two flat wire meshes are welded to cover both sides of the forming skeleton as a space matrix framework.

As in prior art the panel framework is composed of a large number of wire trusses and the interior of the matrix is filled with unicellular rigid form materials reinforced with iron linings and strings or wires. However, as prior art panels are not immune to such drawbacks as: (a) the panel framework can only stand a compression $F_1$ and moment $M_1$ from the two directions as shown in FIG. 1; the same panel framework can not stand the compression $F_2$ and torsion $T_1$, $T_2$ from the directions shown in FIG. 1 (the rigid foam material, as the substructure thereof, is readily susceptible to loosening), (b) the frequent and multiple joint points between the components comprising said three-dimensional framework required a much too complicated processing and production procedure because their link as a concrete mass depends entirely on welding spot joints and connection areas, more specifically the rigid foam elements as constituent materials have to be made into strips for lining up (side by side) before being the point-welded (forming a three-dimensional skeleton framework) and then pressed against the outside of the rigid foam materials (laying side by side).

SUMMARY OF THE INVENTION

In accordance with a preferred embodiment of the present invention, a light-weight thermal insulation material is inserted onto the back and loin sections of a folded metal wire mesh or plate structure. Two flat metal wire meshes profiled like two flat boards are then used to cover both sides of the framework. Spot welding is employed to combine the two flat metal meshes with the folded mesh or plate (with light-weight thermal insulation inserted). The object of this invention is to take advantages of folded plates and space frame structure to provide a multi-purpose construction panel which can withstand compression, tension, and bending stress.

Another object of this invention is to provide by precasting production achieved of thermal and sound insulating properties and impervious to the passage of moisture and vibration-resistance performance at lightest possible weight compositions.

These and other objects of the present invention will be more apparent by illustrating preferred embodiments with reference to the following drawings.

BRIEF DESCRIPTION OF THE DRAWINGS

FIG. 2-1, 2-2, 2-3, are perspective views of a multi-reinforce construction panel according to the present invention.

FIG. 3-1, 3-2, 3-3, 3-4, illustrate a molding process according to the present invention.

DETAILED DESCRIPTION OF THE DRAWINGS

Figure 1:
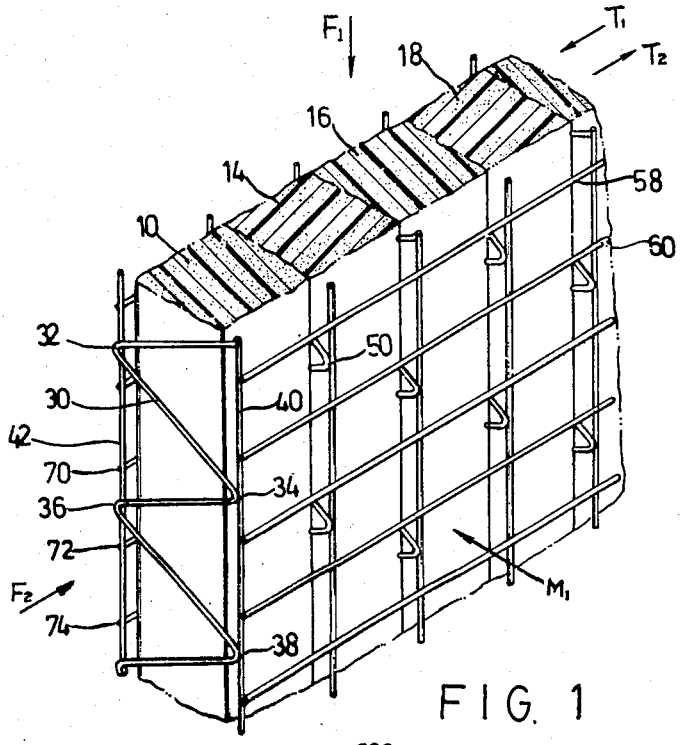
FIG. 1 is a perspective view of a light-weight construction board in the prior art.

As shown in FIG. 1, whereof a reinforced modular foam panel which forms a two dimensional matrix framework is bent to take formations by the bending and deflection treatment of curved wires 30 that are a little bit harder in property, the top points such as 32, 34, 36, 38 formed as they are by alternative settings are secured to a curved stem wire 30 by welding and joining techniques as executed to a pair of side rods or metal wires 40, 42, parallel to and separated from each other, pointwelded to the top points on the reverse sides of the curved stem 30, for instance, stem 40 is attached by points 34, 38, whereas stem 42 is attached by points 32, 36, thus accomplishing the framework of a sturdy, flat set, or two dimensional matrix framework secondarily by means of a number of foregoing matrix framework to bind each other which is composed of several longitudinally intermittent intersecting separated bars 58, 60, and the corresponding bar which the same as by intermittent separated but along the matrix panel to fix. Then each bar being spot welding to a side bar 40 as provided on the sides of each lattice structure that altogether makes up the whole framework and secured thereafter.

On the other side of the lattice there are provided a number of longitudinally intermittent intersecting bars all these additional multiple cross bars are point-welded to the lateral side 42 close to the second stem corresponding to the other surface of each sub-structure; this being done, the lattice structure will provide for the three-dimensional skeleton of the whole structure, followed by the insert onto the light-weight raw materials 10, 14, 16, 18, therein.

Figures 2, 3:
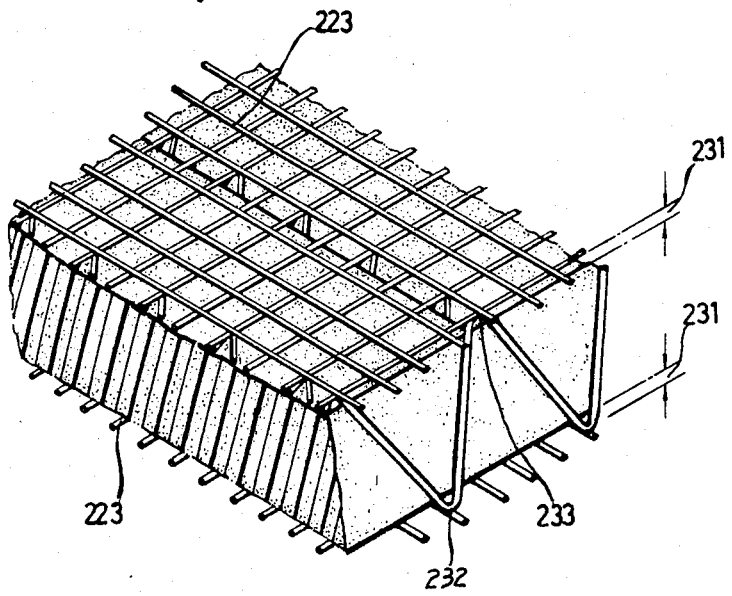
Figures 1, 2:
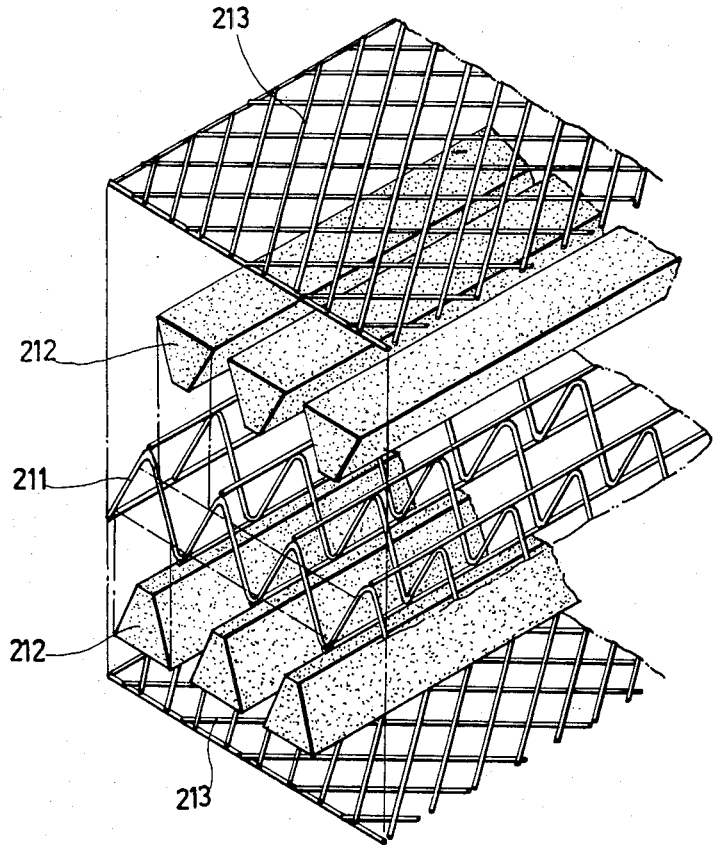
Figure 2:
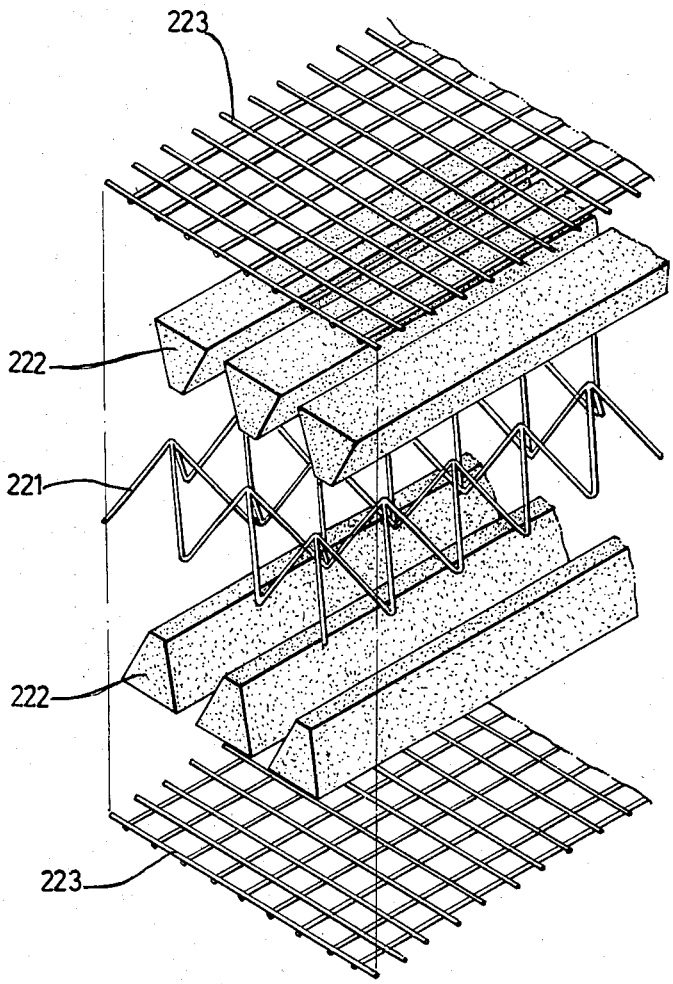
Figures 1, 3:
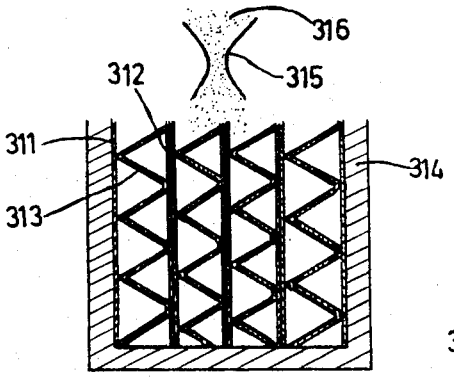
Figures 2, 3:
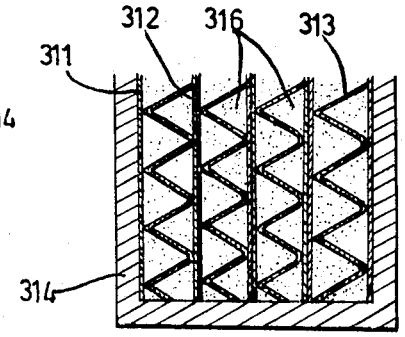
Figure 3:
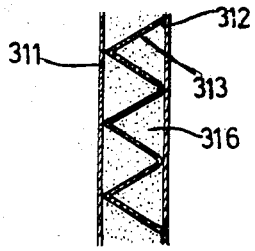
Figures 3, 4:
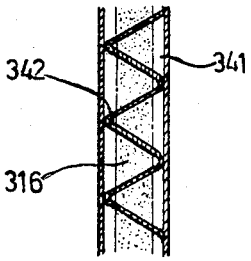

Regarding the present invention, to put the invention to a completed status, the back and loin sections of the metal wire mesh structure formed according to the invention, will be inserted with light-weight thermal insulation raw material to be bonded altogether. The inserting procedure can be performed in any of the three methods listed below: Firstly, to stuff the light-weight thermal insulation material into the back and loin sections is after the formation of the folded metal wire mesh or plate structure each of its own configuration. Then stuff with light-weight thermal insulation raw materials into embodiment, thereafter put two metal wire meshes over both sides of the folded mesh or plate, to follow that, welding spot process will be employed to combine the two flat metal wire meshes with the folded metal wire mesh or the folded plate. Referring to FIG. 2-1, FIG. 2-2, it is seen that the folded metal wire mesh 211, 221 structure which can be folded by press machine working structurally as a folded plate, the metal mesh can be folded into any shape whatever without losing such merits as resistance to torsions, resistance to shearing stress and compression stress application. Alternatively, the light-weight raw material 212, 222 may be inserted onto the folded metal wire mesh or plate structure 211, 221, separately with some clearence left 231 as shown in FIG. 2-3 between the top and the bottom points 232,233 of the metal wire mesh framework, to be completed by covering two flat metal meshes 213 as shown in FIG. 2-1 or 223 as shown in FIG. 2-2 and by the application of point welding techniques to embody it to the structural body of the metal mesh panel formed up earlier. There is one thing to note at this point; that is the fabric pattern of the two metal meshes can be chosen for structural purpose, and the mode to cover the metal wire meshes 211, 221 having flat panel profile over the framework completed by inserting the light-weight raw materials can be such as to be parallel to the direction as formed by the original metal wire mesh panel as shown in FIG. 2-2, 223, or be such that a miter crossing shape as 213 shown in FIG. 2-1 cover up may be employed instead, before welding spot is applied, such as is exemplified by FIG. 2-1, and FIG. 2-2, meaning to fortify its strength to resist stress due to shearing of bending endeavours uncalled for. A construction board incorporated according to the formation method described in the foregoing is illustrated in FIG. 2-3. Secondly, to stuff the light-weight thermal insulation material into the back and loin section of the metal skeleton is after the formation of the two flat set metal wire meshes together with the folded metal web boards (processed to give a particular configuration of its own such as an acute V formation, a square wave formation, a trapezoidal formation) over the cross section area, will be welded to come into a three-dimensional structure of a metal framework then to put the raw light-weight materials, such as expanded polystyrene, or foamed PU strips, and reinforced with bonding agents thereafter to substantiate a firm embodiment with the metal mesh structure. Thirdly, as shown in FIG. 3-1 to FIG. 3-4 that is adoption of molding process formation method, first of all for this process is the two flat metal meshes will be welded to the folded metal mesh or plate 313 to form the three dimensional skeleton to stand as a unit of its own. Then the skeleton will be placed into the molding flask 314 as shown in FIG. 3-1 thereafter by pouring cup 315 to pour the light-weight thermal insulation material 316 into the metal skeleton as shown in FIG. 3-2 then use the right solvents or heater at both side of the metal skeleton cast with light-weight thermal insulation unit as shown in FIG. 3-3 can be melted away part of the light-weight thermal insulation to get the clearance gaps 341, 342, as shown in FIG. 3-4 between the rest insulation and the two flat meshes.

With the invention thus explained it is apparent that obvious modifications and variations can be made without departing from the scope of the invention. It is therefore intended that the invention should not be limited beyond that indicated in the appended claims.

What is claimed is:

1. A structural rreinforcement grid consisting essentially of two substantially planar sections of wire mesh and a third section of multiply-pleated wire mesh or of multiply-pleated metal plate;

the third section having a configuration, in profile, of acute "V" formations, natural wave formations, square wave formations or trapezoidal formations;

said third section being sandwiched between and welded to each of the two substantially planar sections at points of contact; and the grid being one wherein said substantially planar sections lie in substantially parallel planes.

2. A grid according to claim 1 wherein the third section comprises multiply-pleated wire mesh.

3. A grid according to claim 1 wherein the third section comprises multiply-pleated metal plate.

4. A light and tough thermal insulation panel reinforced throughout substantially its entire extent by a structural reinforcement grid according to claim 1.

5. A panel according to claim 4 of expanded polystyrene.

6. A panel according to claim 4 of foamed polyurethane.

7. A panel according to claim 4 having a fire-resistant coating on at least one surface.

8. A panel according to claim 4 having, on at least one surface, a coating of cement plaster, of stucco or of gypsum.

* * * * *